US006424512B1

(12) United States Patent
Schmacht

(10) Patent No.: US 6,424,512 B1
(45) Date of Patent: Jul. 23, 2002

(54) CIRCUIT ARRANGEMENT AND METHOD FOR PROTECTING A CONTROL ELEMENT AGAINST OVERCURRENT

(75) Inventor: Thomas Schmacht, Erdweg (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 09/508,161

(22) PCT Filed: Aug. 17, 1998

(86) PCT No.: PCT/DE98/02375

§ 371 (c)(1),
(2), (4) Date: Mar. 7, 2000

(87) PCT Pub. No.: WO99/13390

PCT Pub. Date: Mar. 18, 1999

(30) Foreign Application Priority Data

Sep. 8, 1997 (DE) ..... 197 39 246

(51) Int. Cl.[7] ..... H02H 3/08
(52) U.S. Cl. ..... 361/93.1
(58) Field of Search ..... 361/18, 56, 58, 361/93, 111, 118, 119; 323/265, 266, 270, 271, 273, 274, 276, 277–282; 363/59, 60

(56) References Cited

U.S. PATENT DOCUMENTS

| | | | | | |
|---|---|---|---|---|---|
| 4,704,572 | A | | 11/1987 | Melbert | 323/275 |
| 4,835,649 | A | | 5/1989 | Salerno | 361/18 |
| 5,128,823 | A | * | 7/1992 | Fujimoto et al. | 361/93 |
| 5,319,515 | A | * | 6/1994 | Pryor et al. | 361/93 |
| 5,539,603 | A | | 7/1996 | Bingham | 361/56 |
| 5,625,519 | A | * | 4/1997 | Atkins | 361/93 |
| 5,642,251 | A | * | 6/1997 | Lebbolo et al. | 361/84 |
| 5,670,867 | A | | 9/1997 | Mitsuda | 323/312 |
| 5,680,035 | A | | 10/1997 | Haim et al. | 323/277 |
| 5,946,270 | A | * | 8/1999 | Jang | 361/91.2 |
| 6,118,641 | A | * | 9/2000 | Atkins et al. | 361/58 |

FOREIGN PATENT DOCUMENTS

| | | | |
|---|---|---|---|
| DE | 39 31 893 A1 | | 6/1990 |
| DE | 0570767 | * | 5/1993 |
| EP | 0 485 119 A2 | | 5/1992 |

OTHER PUBLICATIONS

A.D.V.N. Kularatna, "Foldback limiter protects high–current regulators", Designer's casebook, Electronics, (1980), 1 page.

* cited by examiner

*Primary Examiner*—Jessica Han
*Assistant Examiner*—Pia Tibbits
(74) *Attorney, Agent, or Firm*—Morrison & Foerster, LLP

(57) ABSTRACT

A circuit arrangement and method for overload protection for a control element is provided, wherein the voltage across a control path of the control element is monitored and utilized as a criterion for shutting off the control element. The actual shutting off of the control element is effected through the aid of a protection circuit that inhibits the control element above a critical current level.

10 Claims, 3 Drawing Sheets

CIRCUIT ARRANGEMENT AND METHOD FOR PROTECTING A CONTROL ELEMENT AGAINST OVERCURRENT

BACKGROUND OF THE INVENTION

For monitoring a control element, it was previously standard to measure the current flow through a precision resistor arranged at the input of the control path of the control element and, when an upper limit of a predetermined current value was exceeded, the control element was driven such that it was shut off.

SUMMARY OF THE INVENTION

The present invention is, in part, based on an object of specifying a circuit arrangement, as well as a method, for overload protection for a control element.

This and other objects are achieved by a circuit arrangement for overload protection of a first control element including a voltage source and a load. In addition, the first control element includes a first control path that selectively connects the voltage source to the load. The first control element also has at least one control input for selectively controlling the first control path and at least one output terminal connected to the load and at least one input terminal connected to the voltage source. The at least one output terminal connected to the load comprises a first control path output and the at least one input terminal connected to the voltage source comprises a first control path input. In addition, the circuit arrangement includes a protective circuit arranged in parallel to the first control path of the first control element. The protective circuit is configured to monitor voltage across the first control path and drive the control input of the first control element when a short in the load occurs such that the load is separated from the voltage source.

According to another aspect of the present invention, a method for overload protection of a first control element having a control path that connects a load to a voltage source includes first monitoring a voltage across the control path of the first control element. A control input of the first control element is then driven when a short circuit in the load occurs wherein the control path of a first control element is interrupted and the load is separated from the voltage source.

The present invention is advantageous in that due to an evaluation of the voltage potential of the control path of the control element, the control element is dependably and reliably protected against overload.

The invention yields the further advantage that an input resistor of a control element can be dimensioned smaller and, as a result, a higher voltage potential can be taken at the output of the control element.

Additional advantages and novel features of the invention will be set forth, in part, in the description that follows and, in part, will become apparent to those skilled in the art upon examination of the following or may be learned by practice of the invention. The advantages of the present invention may be realized and attained by means of instrumentalities and combinations particularly pointed out in the appended claims.

BRIEF DESCRIPTION OF THE DRAWINGS

Reference is made to the attached drawings wherein.

DETAILED DESCRIPTION OF THE PREFERRED EMBODIMENTS

Figure 1:
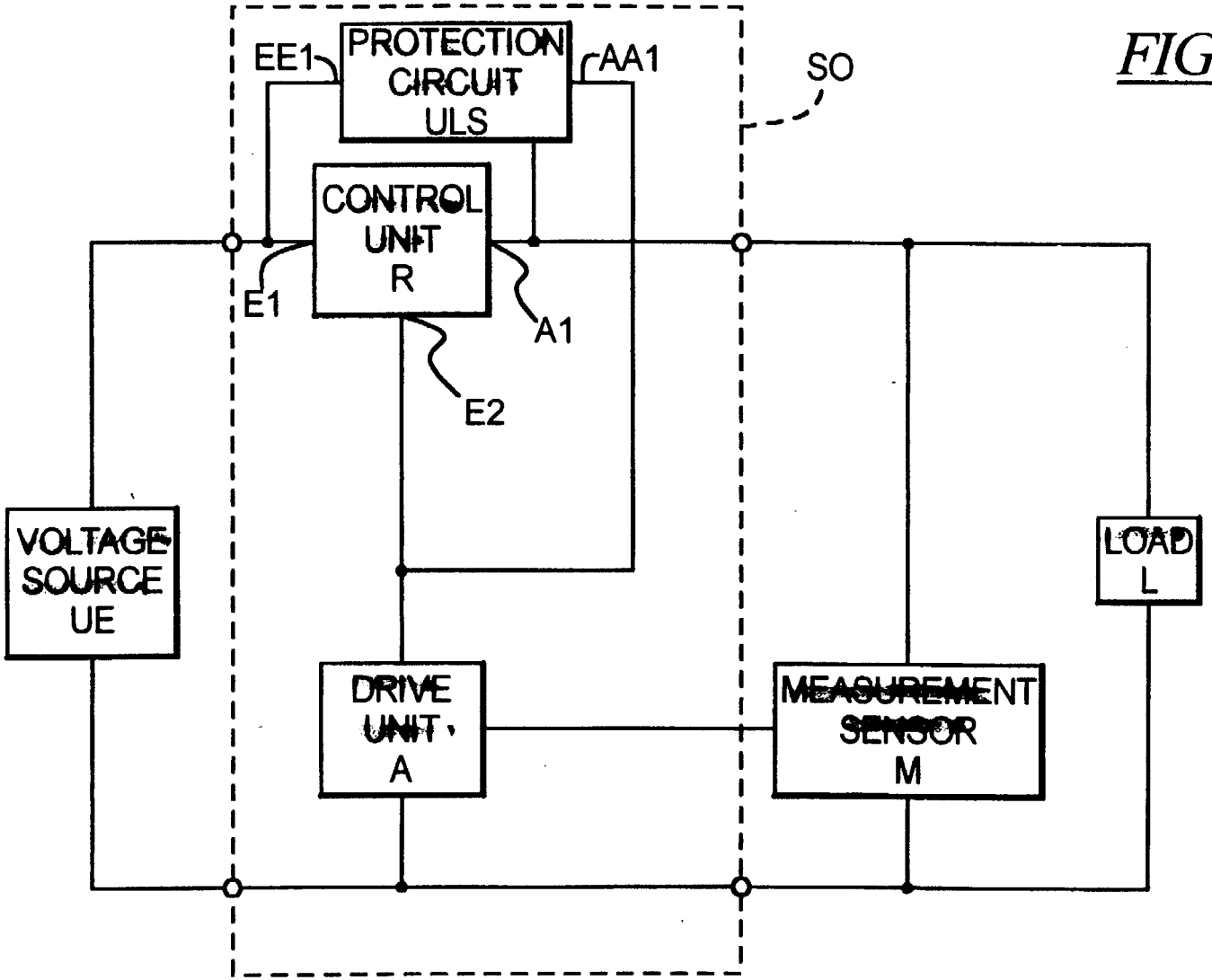
FIG. 1 illustrates a block circuit diagram of a control unit with an overload protection.

FIG. 1 shows a block circuit diagram of a circuit arrangement SO with a control unit R, a protective circuit ULS as well as a drive unit A. At its input side, the circuit arrangement SO is connected to a voltage source UE.

The control unit R is driven by a control unit A in a normal operating case such that a constant output voltage at the output of the circuit arrangement SO is delivered to a user L located at the output of the circuit arrangement SO given an increase in flow of current through said user L. The protective circuit ULS has a first input E1 connected to an output of the control unit R. An input for driving the drive unit A is connected to a measurement sensor M arranged, for example, parallel to the load L. An output of the protective circuit ULS is connected to an input of the drive unit A. Given a short-circuit current through the load L, the short-circuit current is registered by the protective circuit ULS and effects a shut-off of the control unit R.

Figure 2:
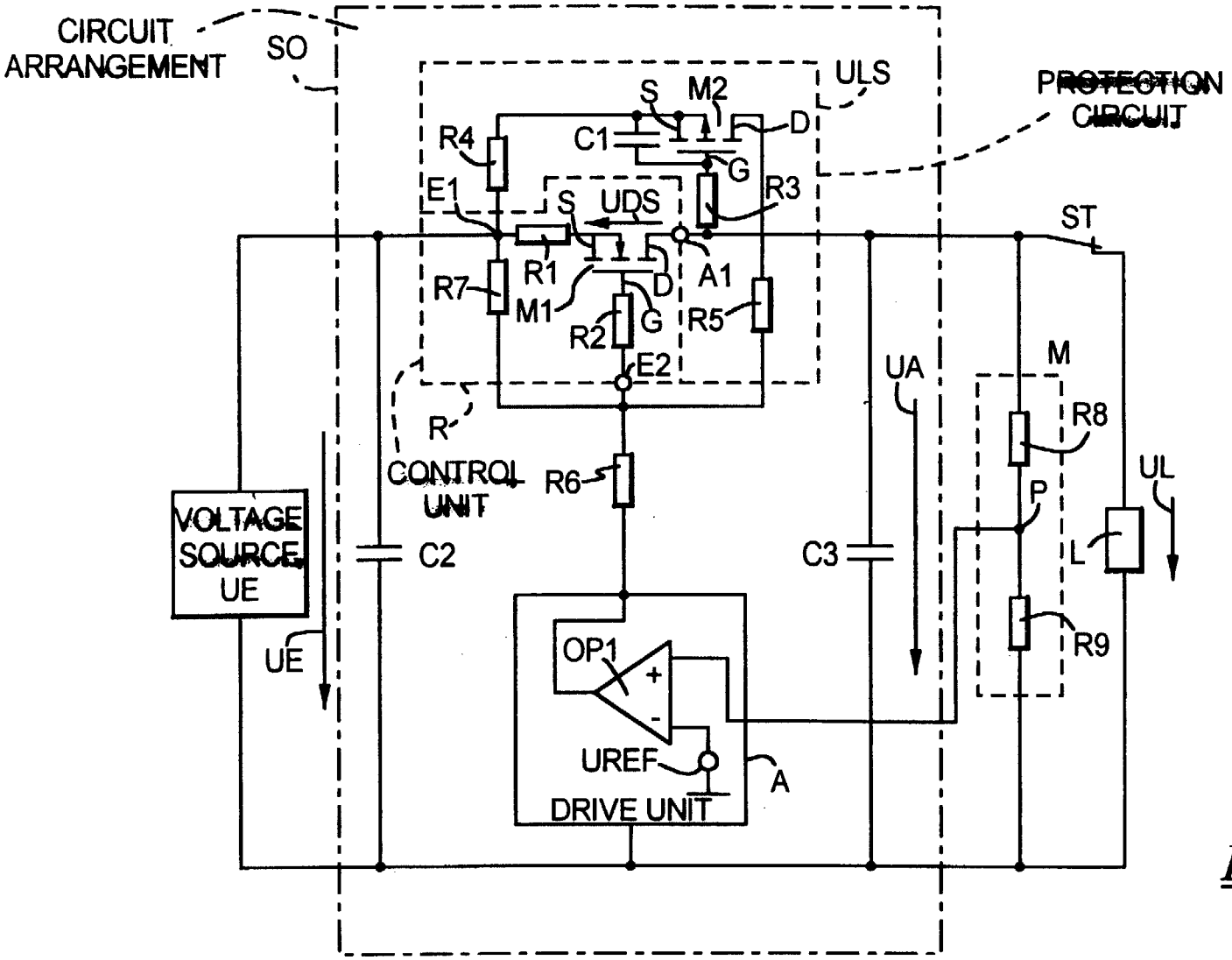
FIG. 2 illustrates a current diagram of the control unit with an overload protection.

FIG. 2 shows a circuit of the block circuit diagram of the control unit R shown in FIG. 1 with the protective circuit ULS. An input resistor R1, a first protection resistor R2 and resistor R7 as well as a first control element M1 are contained in the control unit R. The first control element M1 in this embodiment of the circuit is a MOS switching transistor.

A first input El of the control unit R is connected to a terminal of the input resistor R1 that forms a series circuit with a control path from S to D of the first control element M1. The control input G of the first control element M1 is connected via a first protective resistor R2 to a second input E2 of the control unit R. The first input E1 and the second input E2 are connected via the resistor R7. The second input E2 of the control unit R is connected to a resistor R6 arranged at an output of the drive unit A.

A control input of the drive unit A is connected to a measurement sensor M formed of the resistors R8 and R9 arranged in series. The control A contains an operational amplifier OP1 whose first input is connected to a tap point P that lies between the resistors R8 and R9 of the measurement sensor M and whose second input is connected to a reference voltage source UREF. The output of the operational amplifier OP1 is connected to the second input E2 of the control unit R.

The protective circuit ULS contains a second protective resistor R3, an input resistor R4, a resistor R5 and a second control element M2 as well as a capacitor C1. The second control element M2 is preferably a MOS switching transistor. The input S of the control path from S to D of the second control element M2 and its control input G are connected to one another via the capacitor C1. The input resistor R4 is connected to the input S of the second control element M2 and to the terminal of the protective resistor R1 connected with the first input E1 of the first control element M1. The control element G of the second control element M2 is connected to the output D of the control path from S to D of the first control element M1 via the second protective resistor R3. The output D of the control path from S to D of the second control element M2 is connected via the resistor R5 to the second input E2 of the control unit R. A capacitor C2 is arranged parallel to the input of the circuit arrangement SO, and a further capacitor C3 is arranged parallel to the output of the circuit arrangement SO.

Given an activation of the circuit arrangement SO, the second control element M2,—at the turn-on time,—is prevented from a through-connect by the capacitor C1 arranged between the control input G and the input S of the control path from S to D of the second control element M2. At the moment when the circuit turns on, the second control element M2 has no influence on the circuit arrangement SO. A voltage UDS=UE−UA builds up via the control path S to D of the first control element M1. The output voltage UA of the circuit arrangement SO can rise from 0 volts to a predetermined nominal voltage UL. The current monitoring becomes active after the expiration of a time period that can be set with a RC element formed of the second protective resistor R3 and the capacitor C1.

In normal operation, the first control element M1 in the control unit R is driven by the control unit A via the first protective resistor R2 and the resistor R6 such that an input voltage UE adjacent at the input of the circuit arrangement SO is regulated onto a constant output voltage UA up to a maximally allowed value of current. The first control element M1 is driven dependent on the drive of the control input G of the first control element M1 by the operational amplifier OP1 of the drive unit A. A voltage adjacent at the input S of the control path from S to D of the first switch element M1 is regulated onto a load output voltage UL. When, for example, due to a reduction of the resistance of the load L at the output of the circuit arrangement SO, the output current rises, the voltage across the input resistor R1 rises and the voltage at the resistor R6 is reduced at the output of the drive unit A. The reduction of the load output voltage is forwarded via the measurement sensor M to the drive unit A. A lower voltage at the first input of the operational amplifier OP1 arranged in the drive unit A effects a linear drop of the voltage at the output of the operational amplifier OP1. The voltage between the input S of the control path from S to D and a control input G of the first control element M1 is increased. An increase of the voltage between the control input G and the input S of the control path from S to D of the first control element M1 effects a lowering of the voltage along the control path from S to D of the first control element M1. A reduction in the voltage at the control path from S to D of the first control element M1 effects a corresponding rise of the voltage UL at the load L.

A lowering of the control voltage through the drive circuit A effects an increase of the current through the resistor R7. An increase of the flow of current through the resistor R6 is likewise effected by the increase of current through resistor R7. The increased flow of current through the resistor R6 effects an increase of the voltage across the resistor R6. This simultaneously leads to a reduction of the voltage between the control input G and the input S of the control path from S to D of the first control element M1. A reduction of the voltage between the control input G and the input S of the control path from S to D of the first control element M1 simultaneously effects a re-adjustment of the output voltage. The control mechanism for current limitation is thereby such that the voltage at the output of the drive unit A is continuously reduced. Given a short occurring in the load L, the voltage at the protective resistor R1, via the control path from S to D of the first control element M1 rises, to a maximum and drives the second control element M2. A current flows across the second control element M2, the input resistor R4, the resistor R5 and the resistor R6 at the output of the drive unit A. The series-connected resistors R4, R5 are connected in parallel to the resistor R7 in the driven condition of the second control element M2. In the case of short, the voltage across the resistor R7 is thereby reduced and the voltage across the resistor R6 is increased. The voltage between the control input G and the input S of the control path from S to D of the first control element M1 drops below a through-connect or threshold voltage needed for the through-connect or conduction of the first switch element M1. The voltage UL adjacent at the output of the circuit arrangement SO amounts to nearly 0 volts.

When the value of resistance of the load L at the output of the circuit arrangement SO increases to such an extent that the capacitor C3 is loaded more than it is discharged by the resistance of the load L, the voltage at the output of the circuit arrangement SO (i.e., UA) increases. An increase in the output voltage UA in turn effects a lowering of the voltage between the control input G and the input S of the second control element M2. Due to the lowering of the voltage between the control input G and the input S of the control path from S to D of the second control element M2, the voltage between the input S and the output D of the control path of the second control element M2 is increased. Due to the increase of the voltage at the control path from S to D of the second control element M2, the flow of current in the resistors R4, R5 and R6 is reduced. A corresponding reduction in the voltage at the resistor R6 results in an increase of the voltage between the control input G and the input S of the control path from S to D of the first control element M1. Due to the increase in the voltage between the control input G and the input S of the control path from S to D of the first control element M1, M1 becomes in turn through-connected or conductive, and the voltage UL across the resistance of the load L increases.

Figure 3:
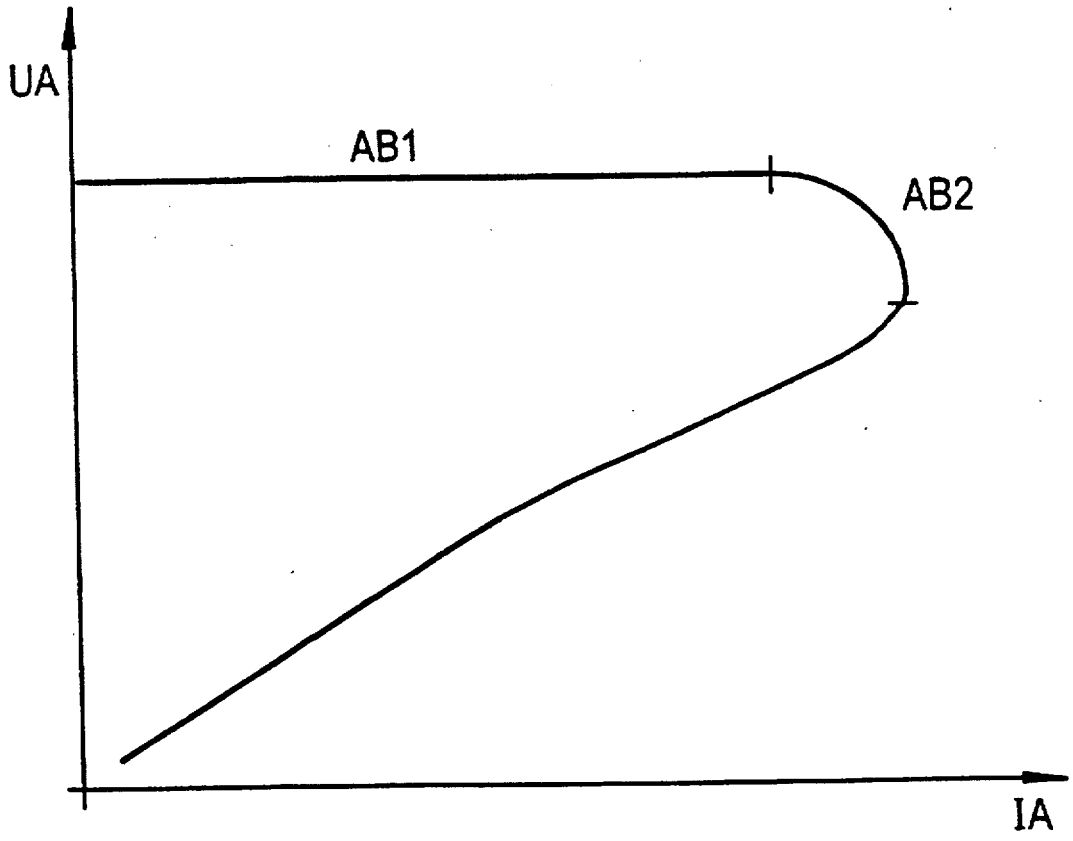
FIG. 3 illustrates a current/voltage characteristic.

FIG. 3 shows a current/voltage characteristic. In the section marked AB1, the drive unit A attempts to drive the first control element M1 such that the output voltage UA remains constant despite an increased flow of current through the load L. In the section of the current/voltage characteristic marked AB2, the protective circuit ULS is active. The flow of current is thereby only slightly increased. The first control element M1 is inhibited above a critical value of current.

While this invention has been described with what is presently considered to be the most practical preferred embodiment, it is to be understood that the invention is not limited to the disclosed embodiment, but, on the contrary, is intended to cover various modifications and equivalent arrangements included within the spirit and scope of the appended claims.

What is claimed is:

1. A circuit arrangement for overload protection of a first control element comprising:

a voltage source;

a load;

a first control element having a first control path selectively connecting the voltage source to the load, at least one control input for selectively controlling the first control path, and at least one output terminal connected to the load and at least one input terminal connected to the voltage source, wherein the at least one output terminal connected to the load and the at least one input terminal connected to the voltage source respectively comprise a first control path output and a first control path input;

a protective circuit arranged electrically parallel to the first control path of the first control element, wherein the protective circuit is configured to monitor voltage across the first control path of the first control element and, drive the control input of the first control element when a short in the load occurs such that the load is separated from the voltage source.

2. The circuit arrangement according to claim 1 further comprising:

a first input resistor arranged between the first control path input and the at least one output terminal of the protective circuit connected to the voltage source.

3. The circuit arrangement according to claim 1 further comprising:

a resistor arranged between the control input of the first control element and the at least one terminal of the protective circuit connected to the voltage source.

4. The circuit arrangement according to claim 2, wherein the protective circuit comprises a second control element having a second control path.

5. The circuit arrangement according to claim 4 further comprising:

a second input resistor having a first terminal connected to an input of the second control path of the second control element and a second terminal connected via the first input resistor to the first control path input, and a third resistor arranged at an output of the second control path of the second control element and connected via a first protective resistor to the control input of the first control element.

6. The circuit arrangement according to claim 4, wherein the first and second control elements are MOS transistors.

7. The circuit arrangement according to claim 5 further comprising:

a control input of the second control element connected via a second protective resistor to the first control path output.

8. The circuit arrangement according to claim 5 further comprising:

a drive unit having an output that is connected via the first protective resistor to the control input of the first control element and an input of the drive unit connected to a measurement sensor connected to the load.

9. The circuit arrangement according to claim 7 further comprising:

a capacitor is arranged between the input of the second control path and the control input of the second control element.

10. A method for overload protection of a first control element having a control path that connects a load to a voltage source, the method comprising the steps of:

monitoring a voltage across the control path of the first control element; and driving a control input of the first control element when a short circuit in the load occurs, wherein the control path of the first control element is interrupted and the load is separated from the voltage source.

* * * * *